US005494289A

United States Patent [19]

Mehrens

[11] Patent Number: 5,494,289

[45] Date of Patent: Feb. 27, 1996

[54] GOLF TRAINING AID FOR PUTTING

[76] Inventor: Rita L. Mehrens, 528 Brackenwood Pl., Palm Beach Gardens, Fla. 33418

[21] Appl. No.: 459,842

[22] Filed: Jun. 2, 1995

Related U.S. Application Data

[62] Division of Ser. No. 219,619, Mar. 29, 1994, Pat. No. 5,443,264.

[51] Int. Cl.[6] ..... A63B 69/36

[52] U.S. Cl. ..... 273/186.1; 273/35 A; 273/32 B; 273/428; 359/870; 359/871

[58] Field of Search ..... 273/186.1, 187 R, 273/187 A, 187 B, 187.1, 187.6, 35 A, 32 B, 32 H, 428; 434/252; 359/870, 871

[56] References Cited

U.S. PATENT DOCUMENTS

| | | | |
|---|---|---|---|
| 1,596,110 | 8/1926 | Lynch | 273/187.1 |
| 3,827,696 | 8/1974 | Schafer | 273/187.6 |
| 4,319,755 | 3/1982 | Orser | 273/428 |
| 5,294,124 | 3/1994 | Florian | 273/35 A X |

*Primary Examiner*—George J. Marlo

*Attorney, Agent, or Firm*—John F. A. Earley; John F. A. Earley, III

[57] ABSTRACT

A golf training aid for putting comprises a sheet of stiff material made in the form of a five-pointed star with a body portion, a forward point portion extending forwardly from the body portion with an aiming and digging flange at the forward end of the forward point portion, which extends at right angles to the body portion for aiming along a line to the target, two side point portions extending sideways away from the body portion and having forward edges which terminate in side points, two rear point portions extending rearwardly from the body portion which terminate in rear points, and a forward stub connected to the flange by a bend line. The digger flange is wide enough to prevent movement of the star when the flange is inserted into the ground.

5 Claims, 1 Drawing Sheet

GOLF TRAINING AID FOR PUTTING

This is a divisional of application Ser. No. 08/219,619 filed on Mar. 29, 1994, now U.S. Pat. No. 5,443,264.

BACKGROUND OF THE INVENTION

1. Field of the Invention

This invention relates to training aids for golf, and more particularly relates to a golf training aid for putting.

2. Description of the Prior Art

Golfers are trying to improve their golf games by practicing with training aids that assist them in perfecting a good golf swing. Such aids are available to assist in practicing the full swing, the short game swing, and the putting stroke.

One of the big problems in putting is in lining-up the putter head so that it is square to the line to the target, whether that be the hole, or whether it be a spot on the green that if hit will allow the golf ball to curve into the hole because of the undulations and uneven surface of the green.

A big problem with putting is making sure that the putter head is square to the line, and many players are putting, and practicing putting, and are completely unaware that their putter blade is not square to the target line, because they must stand to the side of the ball.

If a golfer lines-up a putt, takes his putting set-up over the ball, and asks a fellow golfer to hold the putter by the top of the grip to hold it in the position the putter has assumed at set-up, the golfer is often amazed when he steps back and looks at the face of the putter blade to find that the face of the putter blade is aimed nowhere near his target and is not square to his target line.

SUMMARY OF THE INVENTION

It is an object of the present invention to provide a golf training aid for putters which overcomes the problem of the putter blade not being square to the target line, and assures the golfer that the putter face is square so that he may now concentrate on speed and distance of his putts without worrying about whether his putter face is square to the target line or not.

DETAILED DESCRIPTION OF THE INVENTION

Figure 1:
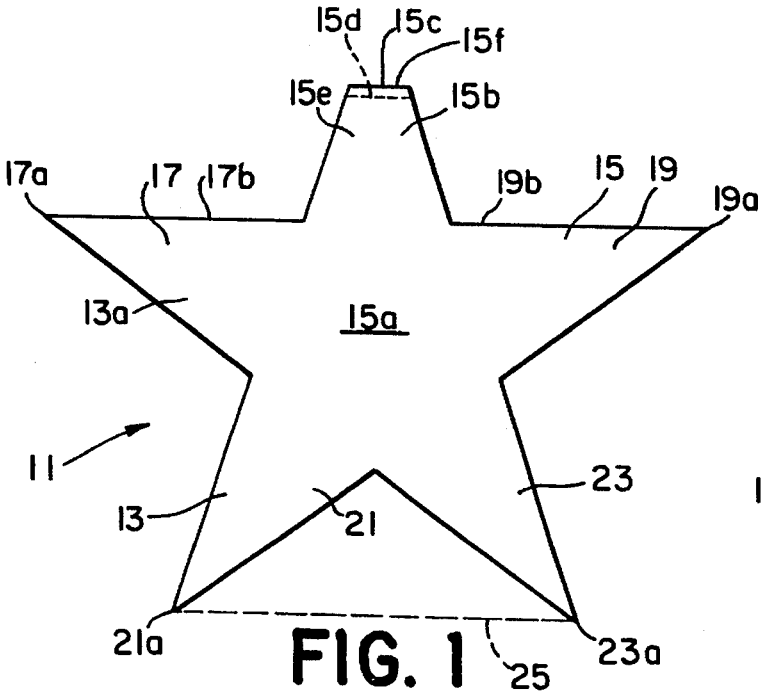
FIG. 1 is a view in top plan of a golf training aid for putting which is constructed in accordance with this invention and which shows a five-pointed star with forward point portion which has a bend line from which depends a digger flange.
Figure 2:
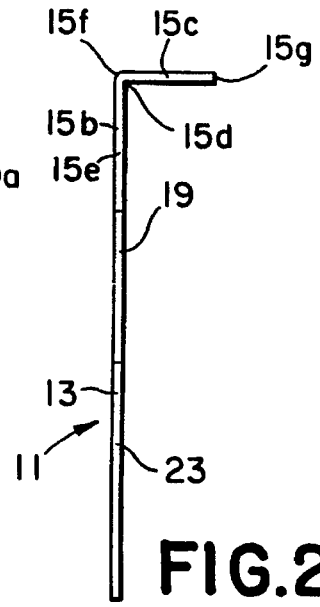
FIG. 2 shows a view in side elevation of the star of FIG. 1.
Figure 4:
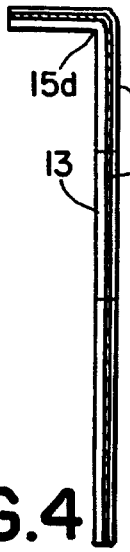
FIG. 4 is a view in side elevation of another embodiment of the invention with a reflective layer connected to the body of the star by an adhesive layer.

Turning now to the drawings, there is shown a golf training aid 11 for putting which comprises a sheet 13 of stiff material, preferably metal, that has a reflective upper face 13*a* which may be a characteristic of the sheet 13 itself, as in FIGS. 1 and 2, or may be a reflective layer 13*b* attached to the top surface of the sheet 13 by an adhesive layer 13*c* as shown in FIG. 4.

The sheet 13 is preferably made in the form of a five pointed star 15 with a body portion 15*a*, a forward point portion 15*b* extending forwardly of the body portion 15*a* with a digger forward flange 15*c* extending from forward point portion 15*b* at about a right angle (90°) to the body portion 15*a* for aiming along a line to the target of a golf ball, which may be the hole or may be a spot on a line to the hole. The forward flange 15*c* depends from the forward point portion 15*b* along bend line 15*d*, and divides the forward point portion 15*b* into digger forward flange 15*c* and a forward stub 15*e* having a forward edge 15*f*.

Two side point portions 17, 19 extend sideways from the body portion 15*a* to terminate in side points 17*a*, 19*a*.

Two rear point portions 21, 23 extend rearwardly from the body portion 15*a* to terminate in rear points 21*a*, 23*a*.

Before forward flange 15*c* is bent along bend line 15*d*, its forward point 15*g* is on the circumference 16 of the same circle as side points 17*a*, 19*a* and rear points 21*a* and 23*a*.

Forward flange 15*c* extends at about 90° from forward stub 15*e*, and the digger flange 15*c* is wide enough to prevent movement of the star 15 when the digger flange 15*c* is inserted into the ground to anchor the star 15 in place.

Forward edges 17*b* and 19*b* of side point portions 17 and 19 are along the same line and are square to the putting line indicated by the forward point portion 15*b* so that a putter face which is placed parallel to, or on, the forward edges 17*b* and 19*b* is square to the target line. Also the forward edges 17*b* and 19*b* of the two side point portions 17 and 19 are parallel to a line 25 between rear points 21*a* and 23*a* so that a putter face which is placed on the line 25 between points 21*a* and 23*a* is also square to the target line.

Figure 3:
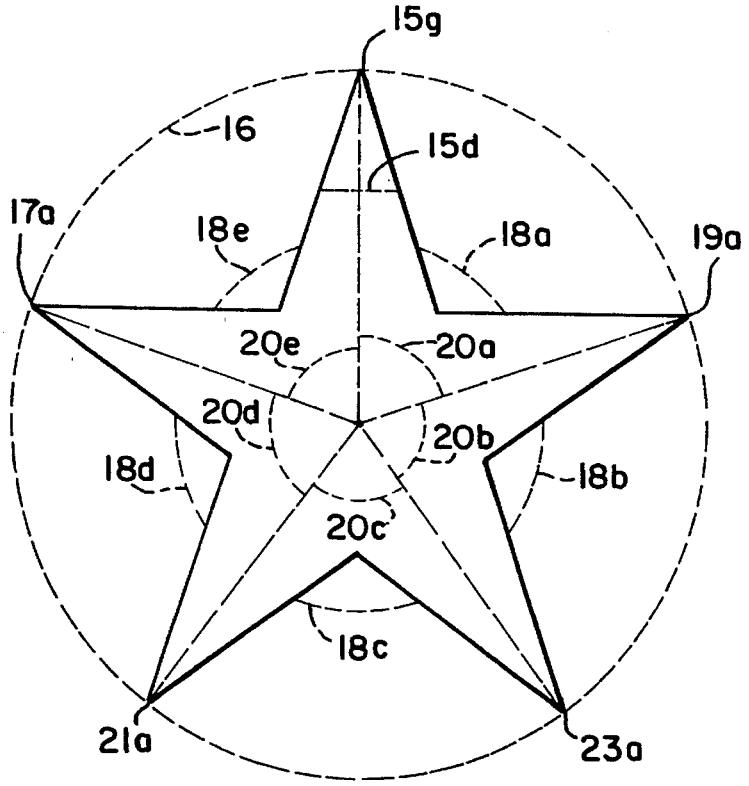
FIG. 3 shows a view in top plan of the putting star before the flange is bent along the bend line.

The five points 15*g*, 17*a*, 19*a*, 21*a*, and 23*a* of the star 15 are all on the circumference 16 of a circle when the star is in flat condition before flange 15*c* is bent at about a 90° angle, and adjacent star sections are separated by an angle 18*a*–18*e* of 108°. Center angles 20*a*–20*e* are all 72° as shown in FIG. 3.

A method of using the golf training aid 11 to enable a golfer to line up his putt and square the face of his putter to the target line comprises the steps of standing or placing the star 15 upright on the ground, i.e., perpendicular to the ground, supported on rear points 21*a* and 23*a* which contact the ground and support the star 15, holding the star upright with his fingers. Then the golfer aims the forward flange 15*c* along the target line to the target. When the golfer is satisfied that the forward flange 15*c* is aimed correctly, the golfer flops the star 15 forwardly using the rear points 21*a*, 23*a* as pivot points. Then he pushes the digger forward flange 15*c* into the ground to hold the star 15 in place with the forward stub 15*e* pointed along the target line and the forward edges 17*b* and 19*b* being square to the target line. The line 25 between points 21*a* and 23*a* are also square to the target line and parallel to the edges 17*b* and 19*b*.

The golfer then places a golf ball in front of the forward stub 15*e*, and addresses the ball with a putter with the putter face being parallel to, or on top of and flush with the forward edges 17*b*, 19*b* of the side point portions 17, 19 to insure that the putter face is square to the target line. He may alternatively place his putter face parallel to, or on top of, line 25 between points 21*a* and 21*b*.

The golfer then draws the putter blade back low to the ground to keep from picking it up, and slides it over the upper surface of the star 15, and strokes the putter blade through the ball while keeping his head steady. The golfer may hold the end of his follow through to see if the putter face is still square to the target line and parallel to the forward edges 17*b*, 19*b*.

Since the golfer has lined up his putter face with the forward edges 17*b*, 19*b* of the side point portions 17, 19, or with the line 25 between points 21*a* and 23*a*, he knows that his club face is square to the target line and may work on speed and distance without worrying about whether or not his putter face is square to the target line.

Another method of using the star 15 as a training aid in practicing putting is to line up the edges 17*b* and 19*b* of the side point portions 17 and 19 along the target line. Then he pushes flange 15*c* into the ground. The golfer then places a ball in front of stub 15*e* and takes his putting stance with his eye over the ball, and his putter blade square to the front edges 17*b* and 19*b* which is square to the target line, to line up his putter face square to the target line. The golfer may check his position by observing his nose and lips in the reflecting upper surface 13*a* of the star 15. The golfer may also check whether or not his head remains steady through the putting swing by observing that his nose and mouth are still seen in the reflecting upper surface 13*a* of the star 15 during his putting stroke.

When using the star 15 in the manner described above wherein the forward edges 17*b* and 19*b* are aimed along the target line, the rear point portions 21 and 23 may show the position of the golfer's shoulders when setting up over the ball and when putting the ball. If the shoulders are square to the target line, they show up in the rear point portions 21, 23. If the shoulders are not square, only one shoulder shows up in the rear point portions 21, 23. So with this immediate feedback, the golfer may square his shoulders by placing them parallel to the target line and observing them in the reflection from rear point portions 21, 23.

A line drawn between adjacent points of the star 15 is parallel to the opposite edge of the star. For example, a line 25 drawn between points 21*a* and 23*a* is parallel to forward edges 17*b* and 19*b*.

ADVANTAGES

The five pointed star 15 of the present invention maybe used to aim at the hole on a straight putt, or it may be used by inserting a tee in the putting surface and using the tee as a target on a sloping green.

The star 15 is small enough that it may be conveniently carried in a golf bag so that it is always available when the golfer desires to practice his putting.

Another advantage of the star 15 is that it may also be used on the course as an instrument for repairing divots on the greens.

The star 15 may also be used as a golf prize for everyone in a tournament, such as in a ladies pink ball tournament, a member-guest tournament, or a pro-am.

Golf training aid 11 may be used by left-handers, as well as right-handers. It may be used to test the speed of the putt on bent grass greens, Bermuda greens, fast greens, slow greens, with grain, against grain, uphill, downhill, and side hill.

The golf training aid 11 may be used by a golfer of any skill level, may be used with very little instruction and does not require instructions by an expert golf instructor.

I claim:

1. A golf training aid for putting, comprising a sheet of stiff material having a body portion, a forward point portion extending forwardly from the body portion with a digger forward flange that extends at right angles to the body portion for aiming along a line to the target, two side point portions extending sideways from the body portion and having forward edges which terminate in side points, two rear point portions extending rearwardly from the body portion which terminate in rear points, said digger flange being wide enough to prevent movement of the aid when the flange is inserted into the ground, the forward edges of the two side point portions being square to the line of the forward point portion so that a putter face which is positioned on or parallel to the forward edges of the side point portions is square to the target line, whereby a golfer may line up his putt, place the aid perpendicular to the ground so that its rear points contact the ground and support the aid upright, aim the digger forward flange along the target line, flop the aid forwardly using the rear points as pivot points, insert the digger forward flange into the ground to hold the aid in place with the forward edges of the side point portions being square to the target line, place a golf ball in front of the digger forward point portion, address the ball with a putter and position the face of the putter blade on or parallel to the forward edges of the side point portions to insure that the putter face is square to the target line, draw the putter blade back low to the ground and slide it over the upper surface of the aid, and stroke the putter blade through the ball while keeping his head steady, whereby by using star putting aid, the golfer knows that the face of his blade is square to the target line and may work on speed and distance of his putts without wondering whether his putter head is aimed correctly.

2. The golf training aid for putting of claim 1, wherein said forward point portion has a forward stub connected between the body portion and the digger flange.

3. The golf training aid for putting of claim 1, wherein said point portion and forward flange from a five-pointed star and the five points of the star are all on the circumference of a circle when said flange is bent to a position coplanar with the body portion, and the angle formed by lines drawn from the center of the circle to adjacent points is 72°.

4. The golf training aid for putting of claim 1, wherein the forward edges of the two side point portions are parallel to a line between the rear points.

5. The golf training device for putting of claim 1, including, reflective means on the sheet for enabling the golfer to observe the position of his head and shoulders when he sets up to the ball with his putter and when he strokes the ball with his putter.

* * * * *